US006001048A

United States Patent [19]

Taylor

[11] Patent Number: 6,001,048

[45] Date of Patent: Dec. 14, 1999

[54] MUSICAL JUMP ROPE

[76] Inventor: Flossie A. Taylor, 4369 Cheviot Dr., Charleston, S.C. 29418

[21] Appl. No.: 09/186,019

[22] Filed: Nov. 4, 1998

[51] Int. Cl.[6] ..... A63B 21/00

[52] U.S. Cl. ..... 482/81; 482/82; 446/242

[58] Field of Search ..... 482/81, 82, 6, 482/1; 110/405; 84/477 B; 119/795; 362/102; 446/242

[56] References Cited

U.S. PATENT DOCUMENTS

| | | | |
|---|---|---|---|
| D. 256,385 | 8/1980 | Fields . | |
| D. 256,899 | 9/1980 | Mazzini . | |
| D. 339,180 | 9/1993 | Taylor . | |
| 3,778,053 | 12/1973 | Smith III, et al. . | |
| 4,082,266 | 4/1978 | Elkins . | |
| 4,090,705 | 5/1978 | Young . | |
| 4,139,966 | 2/1979 | Connell . | |
| 4,192,501 | 3/1980 | Peoples . | |
| 4,529,193 | 7/1985 | Kuhnsman . | |
| 4,776,585 | 10/1988 | Maleyko et al. . | |
| 5,137,488 | 8/1992 | Yeh . | |
| 5,137,503 | 8/1992 | Yeh . | |
| 5,212,333 | 5/1993 | Aryee | 84/477 |
| 5,533,947 | 7/1996 | Tomlinson et al. . | |
| 5,579,692 | 12/1996 | Collier | 101/405 |

*Primary Examiner*—Glenn E. Richmon
*Attorney, Agent, or Firm*—Harleston Law Firm; Kathleen M. Harleston

[57] ABSTRACT

A musical jump rope continuously plays a number of pre-programmed songs, and at the same time provides a display with multiple colored or white incandescent lights. At least one of the jump rope handles comprises: (1) a battery power source, (2) a pre-programmed electronic music chip, (3) a speaker driven by the music chip, (4) a plurality of incandescent lights; (5) at least one activator button for activating the music chip and the incandescent lights; (6) a dual timing circuit for driving the music chip and the incandescent lights for a fixed, pre-set period, and (7) a translucent handle covering. The handle covering may further include odorizing or colorizing means.

6 Claims, 2 Drawing Sheets

MUSICAL JUMP ROPE

CROSS REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Technical Field

The present invention relates generally to playthings, and more particularly to a jump rope capable of continuously playing a number of pre-programmed songs, while at the same time providing a lighting display. In the present device, one or both jump rope handles further comprise odorizing and/or colorizing means.

2. Background Information

The jump rope has been a plaything for children and an exercise device for adults for many years. Various types of jump ropes have been invented over the years, including jump ropes which are rotated by means of electric motors, various types of musical jump ropes, and some jump ropes with lights. The present invention is a jump rope with a battery-operated musical/lighting unit in one or both handles. The handle containing the musical/lighting unit has a translucent covering so that the lighting display is visible. Once the jump rope of the present invention is activated by the user by means of an activator switch, the musical/lighting unit continuously plays a number of pre-programmed songs, and at the same time provides a display with multi-colored or white incandescent lights. In the present invention, one or both jump rope handles further comprise odorizing and/or colorizing means. For example, the handle comprising the musical/lighting unit might be tinted purple and smell like grape bubblegum. The music and lights entertain and engage children and adults as they use the jump rope, or as they observe it. The odorizing and colorizing means further attract and engage the senses of the child. The music, lights, and handle odor and color can be enjoyed whether the user is jumping rope or not.

BRIEF SUMMARY OF THE INVENTION

The present invention is a musical jump rope, comprising: (a) a flexible line having a length sufficient for rotating the line around a person's body as a half loop; and (b) a pair of handles attached to the ends of the flexible line for being grasped by the hands of a user. At least one of the handles comprises: (1) a battery power source, (2) a pre-programmed electronic music chip, (3) a speaker driven by the music chip, (4) a plurality of incandescent lights; (5) at least one activator button for activating the music chip and the incandescent lights; (6) a dual timing circuit for driving the music chip and the incandescent lights for a fixed, pre-set period, and (7) a translucent handle covering. When the user depresses the activator button, music sounds from the speaker and the incandescent lights flash for the fixed, pre-set period for the amusement of the user or observers.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
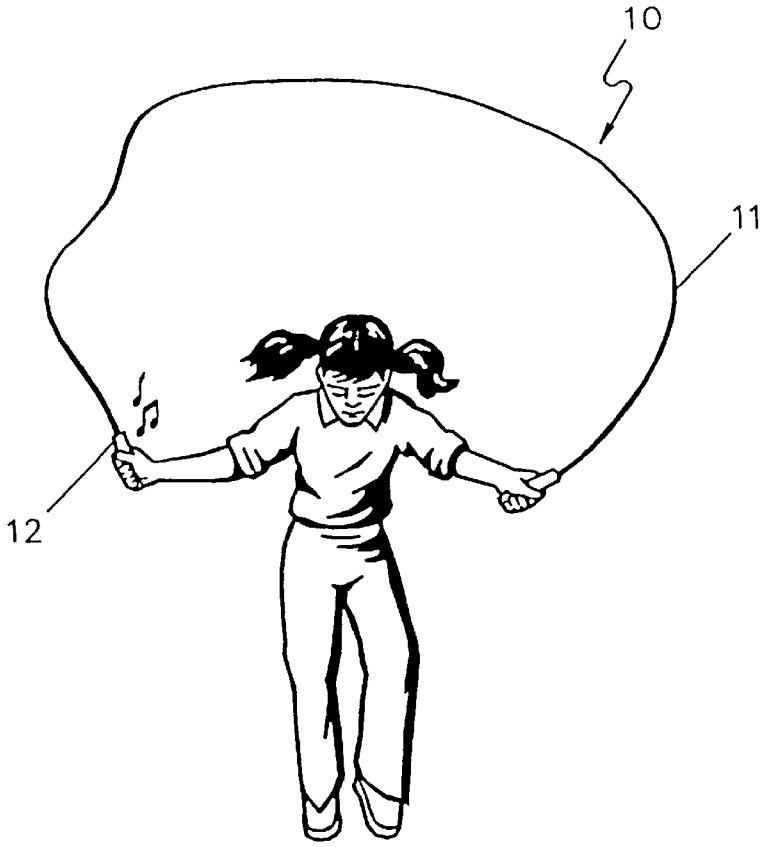
FIG. 1 shows a perspective view of the invention in use.

In the following description, like reference characters designate like or corresponding parts throughout the several views. Also, in the following description, it is to be understood that such terms as "front," "back," within," and the like are words of convenience and are not to be construed as limiting terms. Referring in more detail to the drawings, the invention will now be described.

Referring to FIG. 1, a musical jump rope 10 according to the present invention includes a flexible line 11 having a pair of handles attached to the ends thereof for being grasped by the hands of the user. As shown in FIG. 1, at least one of the handles 12 comprises a battery-operated musical and lighting unit. Here, opposing handles are held by the user and the flexible line is swung around the body of the user while the music sounds and the lights flash in at least one of the handles. This musical jump rope serves to amuse the user and observers.

Figure 2:
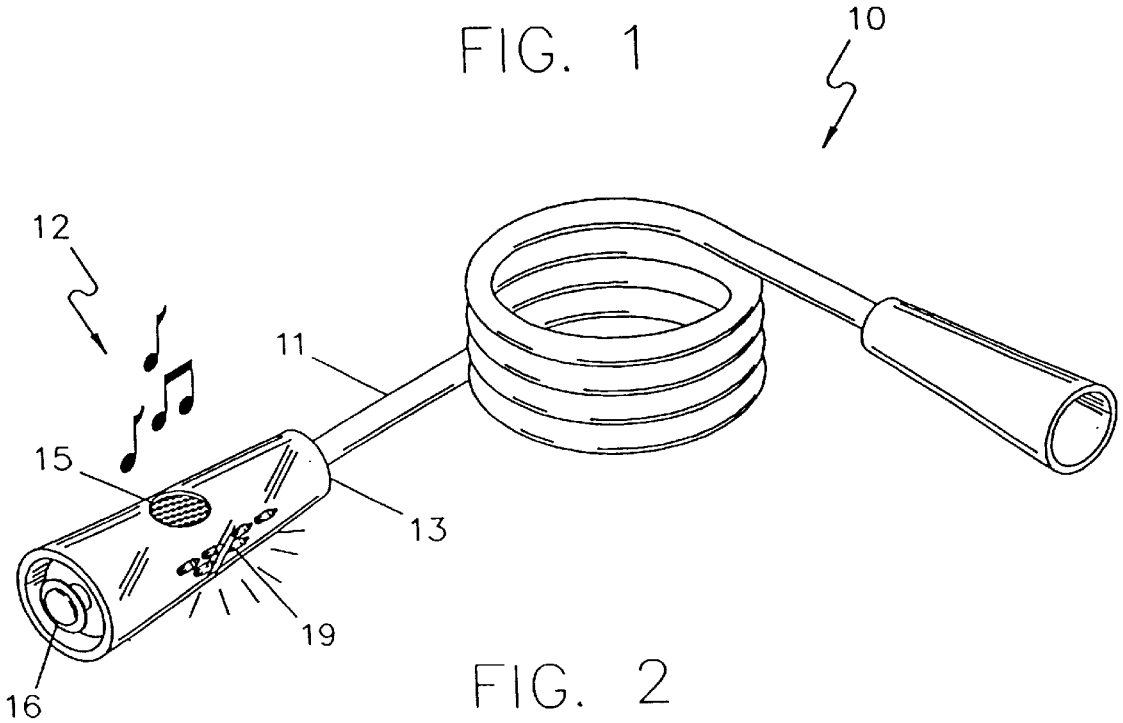
FIG. 2 is a perspective view of a musical jump rope according to the present invention.

As shown in FIG. 2, the musical handle 12 comprises a translucent handle covering 13, which is preferably made of a relatively soft, flexible, durable material so that the handle is comfortable to hold and easy to grasp while jumping rope for a long period. The handle forms a cylindrical hand grip. "Translucent" is meant to include clear, transparent, semi-transparent, and opaque. The handles may be made of high impact injection molded plastic. The handles are secured to the end of the flexible line, preferably by gluing or knotting, so that they are not disengaged by normal wear and tear.

The flexible line is made of a durable, flexible, relatively lightweight material such as plastic or braided cloth. It may be a twisted nylon rope formed of multiple fibers twisted into a secondary cord and then in multiples into the flexible cord. The flexible line has a length sufficient for rotating the line around a person's body as a half loop. The flexible line is long enough to easily be rotated around a child's or adult's body while a handle is held in each hand, depending on the intended user. In some embodiments, the flexible line may be longer, for example, for "double dutch" with two or more players jumping rope simultaneously.

Figure 3:
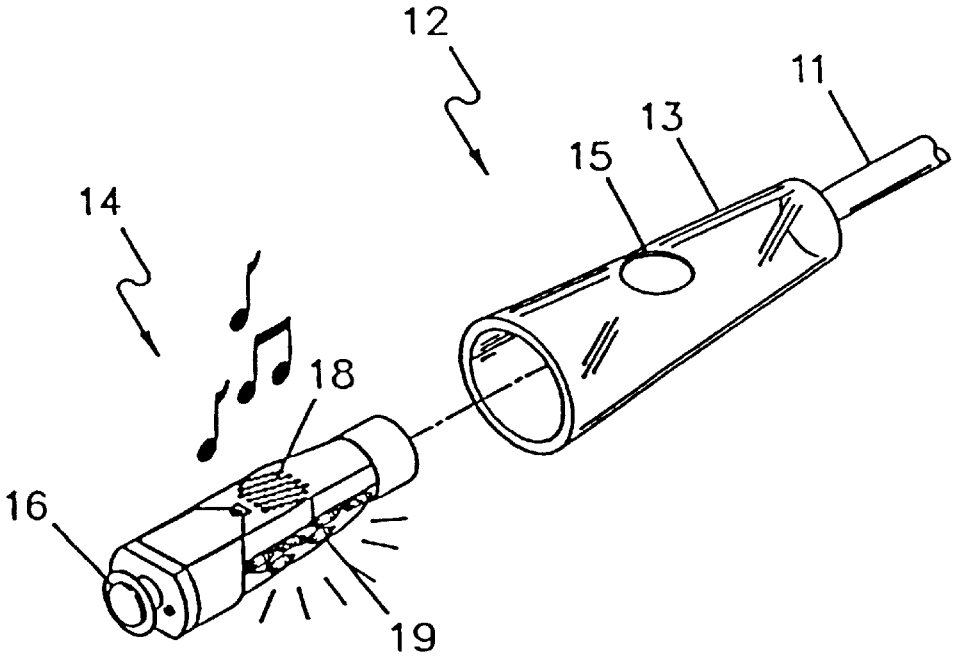
FIG. 3 is a perspective view of a handle of a musical jump rope according to the present invention.

Referring to FIGS. 2 and 3, a removable musical and lighting unit 14 fits within a hollow in the musical handle 12. When it is in place in the handle, the musical/lighting unit 14 is surrounded by the handle covering 13, which is translucent so that the lights inside may be observed. The translucent handle covering 13 preferably comprises at least one aperture 15 to permit pre-programmed music to be heard by the user, as well as observers in the close vicinity, and at least one aperture for an activator switch 16. The user depresses the activator switch 16 to select power to initiate the music and lighting sequence. In FIG. 2, the activator switch is shown in the free end of the musical/lighting handle, where it can be depressed with a thumb. The activator switch could alternatively be a pressure-activated switch located along the side of the musical/lighting handle, where it could be depressed when the user tightly grips the handle. The music and lighting display sequence is pre-programmed and ends automatically. The musical/lighting unit 14 includes an electric circuit with certain electronic components.

Figure 4:
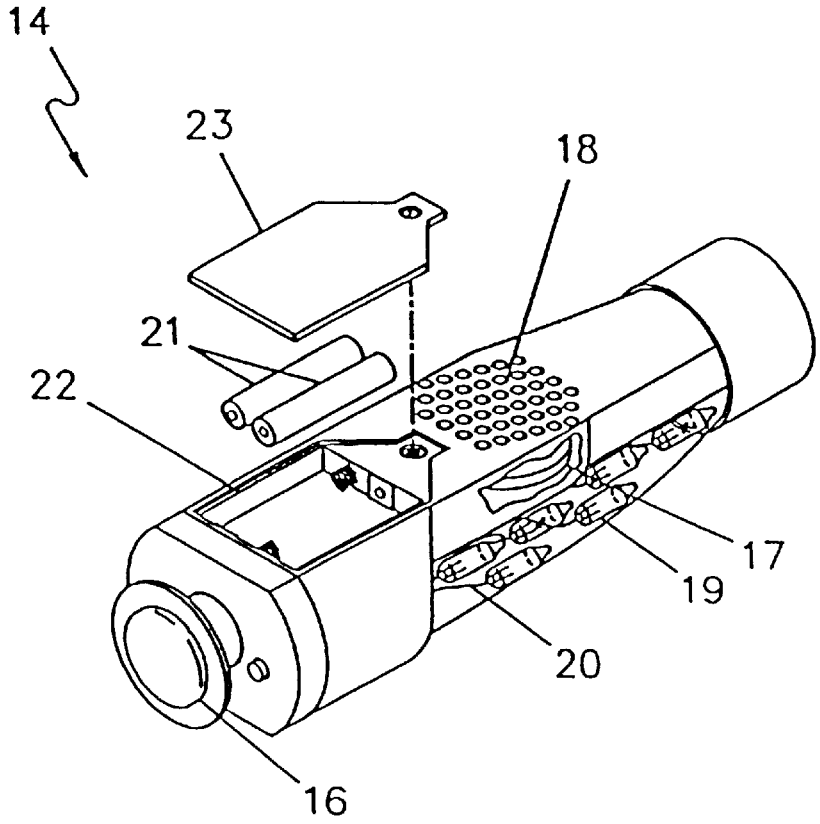
FIG. 4 is a perspective view of the music and lighting unit within the handle shown in FIG. 3.

Referring to FIG. 4, at least one of the jump rope handles 12 comprises: (1) a battery power source, (2) a sound (music) chip 17, (3) a speaker 18 driven by (or connected to) the sound chip, (4) a plurality of incandescent lights 18; (5) at least one activator switch 16 for activating the music chip and the incandescent lights; (6) a dual timing circuit for controlling the timing of the music chip 17 and the lights for a fixed, pre-set period, and (7) a translucent handle covering 13. The translucent handle covering comprises at least one aperture 15 for the speaker and at least one aperture for the activator switch 16. When the user depresses the activator switch 16, pre-programmed music sounds from the speaker 18 and the incandescent lights 19 flash for the fixed, pre-set period for the amusement of the user. The battery power source preferably comprises replaceable DC batteries 20, preferably two or three AA or AAA batteries, and a battery housing 21 with a removable battery cover 22, as shown in FIG. 4.

The musical/lighting unit 14 comprises the speaker 18, which is usually circular and is preferably located along one side of the musical/lighting unit 14. As shown in FIG. 3, the shape and size of the aperture 15 in the translucent handle covering preferably corresponds to the shape and size of the speaker 18. As shown in FIG. 4, the music chip 17 and the dual timing circuit are contained within the music/lighting unit, which is preferably rocket-shaped with the wider end holding the activator switch and the narrower end of the rocket shape holding a knotted end of the flexible line. Internal wiring 20 connects the components along this electric circuit to one another. Certain resistors and capacitors and a microprocessor are preferably also incorporated into the circuit within the music/lighting unit. The music chip 17 is preferably a pre-programmed solid state electronic memory device which stores one or more, most preferably four to ten, songs.

Preferably, the speaker 18 is along one side of the unit housing, which is preferably a sturdy plastic, and the incandescent lights 19 are clustered on the other side. To change the batteries 21, the user unfastens the music/lighting unit 14, which is secured in the handle by a suitable openable locking means, and pulls it partly out of the handle 12. The user replaces the batteries and then secures the unit back in the handle. The music/lighting unit preferably includes a clear plastic cover for the incandescent lights for the further protection of the user. The incandescent lights are laid out along a portion of the length of the handle for visibility from outside the jump rope. The narrower end of the music/lighting unit fits down into the narrow, interior end of the handle covering first, and the wider, exterior end of the music/lighting unit, which preferably holds the activator switch, fits securely into an open end of the handle covering so that it is accessible. There may be means on the exterior end of the music/lighting unit for the user to tighten in order to fasten the music/lighting unit in place in the handle.

Both handles are preferably also odorized and colored or tinted a complementary color to appeal to the senses. An odorous material which emits a selected scent and a colorization selected to impart a visual perception corresponding to the selected scent might be combined with the handle covering material prior to the molding process for the handle covering. A suitable handle covering material might be a thermoplastic base material. For school age users, for example, one or both jump rope handles might be tinted blue and impregnated with a blueberry odor, or pink handles might have a cherry smell, or purple handles may have a grape bubblegum odor. The odor could be one which rubs off on the child's hand as she or he jumps rope/holds the jump rope handle.

The incandescent lights may be different colors, or they may all be white. The songs might be "Mary Had a Little Lamb," "London Bridge is Falling Down," etc. Different songs, colors and/or odors could be employed if target users are adults. The nonmusical handle, if there is one, may be weighted inside the handle to partially balance the weight of the musical handle so that the jump rope is easier to handle.

In use, preferably the user depresses the activator switch 16, and charged capacitors discharge through a resistor to the dual timing circuit. The output drives the music chip. At the same time, input to a second portion of the dual timing circuit drives (is connected to) an oscillator, which is connected to the incandescent lights 19. When the timer completes the pre-programmed cycle, the music and the lights cease playing or flashing. The music is preferably one to ten short, basic tunes familiar to children so that the child can sing or hum and/or jump rope with the music. The music/lighting unit optionally includes a switching means so that the user can select one specific song from the plurality of songs stored within the music chip.

The incandescent lights 19 may simply all flash on and off repeatedly, or they may be programmed (preferred) to flash in time to the music. Although they are visible in daylight, the incandescent lights are more attractive at dusk or at night. This musical jump rope can be used, for example, by children to play the game "snake," where a child holds one handle and vigorously wiggles the rope on the ground in imitation of a moving snake while the other children jump over the rope. The lit (musical) handle would be an effective "snake head." Alternatively, both handles can be musical and/or include light displays. One or more ropes according to the present invention could be used by two or more players, e.g., where two children each turn one end of the jump rope while a third child jumps.

In the present invention, the user preferably does not vary the tempo of the pre-programmed songs using a switch on the jump rope. In the present invention, the lights preferably do not extend down into the flexible line, which is preferably not hollow, and the flexible line is preferably not illuminated from within. The flexible line of the present invention is preferably not translucent or opaque. The handle of the present invention includes a plurality of lights rather than one flashlight-type bulb. The activation of the lights in the present invention is not dependent upon the spinning of the flexible line. In the present invention, the music is from a pre-programmed music chip; there are no reeds within the handle of the present invention to generate the music. The handles of the present jump rope are preferably not in communication with any hollow in the flexible line. This is not an electric jump rope; there is no motor which turns the flexible line.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

What is claimed is:

1. A musical jump rope, comprising:

(a) a flexible line having a length sufficient for rotating the line around a person's body as a half loop; and (b) a pair of handles attached to the ends of the flexible line for being grasped by the hands of a user;

wherein at least one of the handles comprises: (1) a battery power source, (2) a pre-programmed electronic music chip, (3) a speaker driven by the music chip, (4) a plurality of incandescent lights; (5) at least one activator button for activating the music chip and the incandescent lights; (6) a dual timing circuit for controlling the timing of the music chip and the incandescent lights for a fixed, pre-set period, and (7) a translucent handle covering; and wherein, when the user depresses the activator button, music sounds from the speaker and the incandescent lights flash through the translucent handle covering for the fixed, pre-set period for the amusement of the user or observers;

wherein the translucent handle covering further comprises odorizing means; and wherein the tempo of the pre-programmed electronic music is not varied using a switch on the jump rope.

2. A device according to claim 1, wherein the translucent handle covering further comprises at least one aperture for the speaker and at least one aperture for the activator button.

3. A device according to claim 1, wherein the handle comprises a hollow cavity comprising a removable music/lighting unit, the unit comprising the battery power source, the pre-programmed electronic music chip, the speaker, the incandescent lights; at least one activator button and the dual timing circuit.

4. A device according to claim 3, wherein the dual timing circuit comprises a dual timer which controls the music and the flashing of the incandescent lights.

5. A device according to claim 4, wherein the translucent handle covering further comprises coordinated odorizing and colorizing means to attract and engage the senses whether the user is jumping rope or not.

6. A device according to claim 5, wherein the activator switch is along the side of the handle and is activated by the pressure of the user's hand gripping the handle, and the incandescent lights are programmed to flash in time to the music.

* * * * *